US007002540B2

(12) United States Patent
Aoki

(10) Patent No.: US 7,002,540 B2
(45) Date of Patent: Feb. 21, 2006

(54) DISPLAY DEVICE

(75) Inventor: Makoto Aoki, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 591 days.

(21) Appl. No.: 09/900,978

(22) Filed: Jul. 10, 2001

(65) Prior Publication Data

US 2002/0003520 A1 Jan. 10, 2002

(30) Foreign Application Priority Data

Jul. 10, 2000 (JP) ..... 2000-208928

(51) Int. Cl.
*G09G 3/36* (2006.01)

(52) U.S. Cl. ..... 345/89; 345/94; 345/690

(58) Field of Classification Search ..... 345/87, 345/89, 94, 204, 208, 690
See application file for complete search history.

(56) References Cited

U.S. PATENT DOCUMENTS 5,724,054 A * 3/1998 Shinoda ..... 345/60
5,874,932 A * 2/1999 Nagaoka et al. ..... 345/60
6,243,072 B1 * 6/2001 McKnight ..... 345/690
6,249,265 B1 * 6/2001 Tajima et al. ..... 345/63
6,344,839 B1 * 2/2002 Denda et al. ..... 345/60
2001/0048420 A1 * 12/2001 Yamamoto et al. ..... 345/89
2001/0052886 A1 * 12/2001 Ikeda ..... 345/87

FOREIGN PATENT DOCUMENTS

| | | |
|---|---|---|
| JP | 7-271325 | 10/1995 |
| JP | 9-325715 | 12/1997 |
| JP | 11-202285 | 7/1999 |
| JP | 11-202286 | 7/1999 |
| JP | 2000-19486 | 1/2000 |
| JP | 2000-19487 | 1/2000 |
| JP | 2001-100709 | 4/2001 |

OTHER PUBLICATIONS

Korean Official Action, Sep. 30, 2003.

* cited by examiner

*Primary Examiner*—Regina Liang
(74) *Attorney, Agent, or Firm*—Young & Thompson

(57) ABSTRACT

A display device comprises a frame buffer which time-divides a frame displaying one picture into multiple sub-frames, an attenuation signal generating circuit which generates an attenuation signal by dividing the inputted luminosity signal by the designated attenuation coefficient, and a signal switching circuit which inputs luminosity signals before division to the antecedent sub-frame in the relevant frame, at the same time, inputs the above-mentioned attenuation signals after division to the subsequent sub-frame. Consequently, such a hold type display device is realized as is able to control the lowering of the picture brightness, as well as, prevent a moving picture from being unclear, blurred or disordered.

17 Claims, 10 Drawing Sheets

DISPLAY DEVICE

BACKGROUND OF THE INVENTION

This invention relates to a hold-type display device such as a TN (twisted nematic) type color LCD (liquid crystal display). More specifically, this invention relates to a display device whose function is effective in displaying a moving picture.

DESCRIPTION OF THE RELATED ART

The LCD, especially a twisted nematic color LCD, has come into use frequently in the field where CRT (cathode ray tube) displays were conventionally employed. However, the TN type LCDs had an inclination to make a picture unclear and blurred or disordered in case of displaying moving images. This inconvenient phenomenon is occurred because the TN type LCD is a hold type display device which holds the brightness of the previously displayed picture until the next writing signals are inputted to the pixel.

Such problem cannot be found in impulse type display devices including CRTs and light projectors. For, as shown in FIG. 1, using the impulse type display devices, a picture is displayed as pulse at the beginning of one frame (a term for displaying a picture) and the picture is not displayed until the next frame. In this way, the connection of adjacent pictures is cut off and visual persistence is adjusted. As a result, impulse type display devices prevent the picture from being unclear and blurred or disordered.

On the other hand, as shown in FIG. 2, in case of a hold type display device, a picture is held through one frame, and furthermore, at a period of transition to the next frame, rise and attenuation of brightness continue through the relatively long transitional period. In case of a moving picture whose one frame is, for example, 1/60 seconds, the picture changed in a high-speed is displayed consecutively. As a result, persistence of vision makes visual recognition of the picture lowered, and thus, the picture becomes unclear and blurred or disordered.

Although the improvement of transient characteristic, which is found in a hold type display device, is said to be realized by an OCB (optically compensated bend) type LCD and a smectic LCD, the above-mentioned visual problem has not been solved.

In an effort to solve this visual problem, a pseudo impulse method has been proposed, with which one frame of a hold type display device is time-divided into two sub-frames, and the subsequent sub-frame is not displayed as shown in FIG. 3. For instance, in the display devices disclosed in the Japanese Patent Application Laid-Open No. HEI 9-325715, No. HEI 11-202285 and No. HEI 11-202286, consecutive display of a picture through one frame is avoided by turning backlight or shutter on and off. In addition, in the display devices disclosed in the Japanese Patent Application Laid-Open No. 2000-19486 and No. 2000-19487, consecutive display of pictures through one frame is avoided by changing the transmittance of the liquid crystal layer or turning backlight on and off.

In spite of the above-mentioned efforts, when non-display term is provided within one frame, transmission luminance energy per unit time is decreased and the overall brightness of a picture is extremely lowered. For example, letting the duty ratio of display term be 50%, transmission luminance energy is reduced by half. The lowering of transmission luminance energy may be solved by improving the illuminance of backlight. However, it requires lighting devices with high-illuminance and increases power consumption.

The present invention has been achieved to solve the above-mentioned problems.

SUMMARY OF THE INVENTION

Accordingly, it is an object of the present invention to provide a display device which prevents the moving picture from being unclear and blurred or disordered, at the same time, controls the lowering of brightness of the picture.

To achieve the object, there is provided a hold type display device of the present invention which time-divides a frame displaying one picture into multiple sub-frames, and brightness of the subsequent sub-frame is attenuated by the fixed ratio according to brightness of the inputted picture.

As mentioned previously, a moving picture which is displayed by a hold type display device becomes unclear and blurred or disordered. The display device of the present invention is able to solve this visual problem by attenuating brightness of the subsequent sub-frame of time-divided one frame by the fixed ratio according to brightness of the picture inputted to the antecedent sub-frame. Furthermore, since brightness of the subsequent sub-frame is reduced but not totally eliminated, it is not necessary to have lighting devices with high-illuminance as a pseudo impulse type display device wherein the subsequent sub-frame is not displayed.

It is preferable that the display device comprises a sub-frame generating means which time-divides a frame displaying one picture into multiple sub-frames, an attenuation signal generating means for generating an attenuation signal by dividing an inputted luminosity signal by a designated attenuation coefficient and a signal switching means for inputting the luminosity signal before division to the antecedent sub-frame in the relevant frame, and inputting the attenuation signal after division to the subsequent sub-frame in the relevant frame.

Thus, the display device of the present invention is able to achieve the previously stated objective; to prevent the moving picture from being unclear and blurred or disordered as well as control the lowering of brightness of the picture.

It is preferable that the attenuation signal generating means generates a signal by shifting the series of a digitalized luminosity signal in the direction of a low order digit (to the right) and eliminating the digits underflowed due to the shift, and thereby outputs the signal as an attenuation signal.

With the attenuation signal generating means, division of the digitalized luminosity signal can be easily executed by switching lines or using a shift register.

The display device of the present invention may have an integration means for integrating the luminosity signal of entire pixels, which forms a picture of a frame, and an attenuation coefficient generating means for generating an attenuation coefficient which is varied according to the obtained integrated value.

The display device of the present invention changes the attenuation coefficient according to the entire brightness of the picture of a frame, which realizes some improvements including the following two examples. In case of the bright monitor, the display device prevents the picture from being blurred or disordered by enlarging the attenuation coefficient and darkening the subsequent sub-frame. In case of the dark monitor, the display device improves visual recognition for the dark part of the picture by minimizing the attenuation coefficient and brightening the subsequent sub-frame.

The display device of the present invention may have a luminosity classifying means for partitioning the inputted luminosity signal according to the luminosity level, and an attenuation coefficient generating means for generating the attenuation coefficient which is varied according to the partitioned resolution range.

In accordance with a display device of the present invention, the following two attempts are contrary to each other; preventing a moving picture between successive frames from being unclear and blurred or disordered, and securing the contrast of the picture. In order to realize these two attempts appropriately, it is desirable to select the attenuation coefficient F carefully according to brightness of the pixel or the monitor. Taking this point into consideration, when partitioning the inputted luminosity signal according to the luminosity level and generating the attenuation coefficient which varies according to the partitioned resolution range, it becomes possible to prevent a moving picture from being unclear, blurred or disordered, at the same time, to achieve a picture contrast with higher quality. The above-mentioned resolution segment is to be made according to brightness of the individual pixel, as well as, the entire brightness of the picture of the relevant frame.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
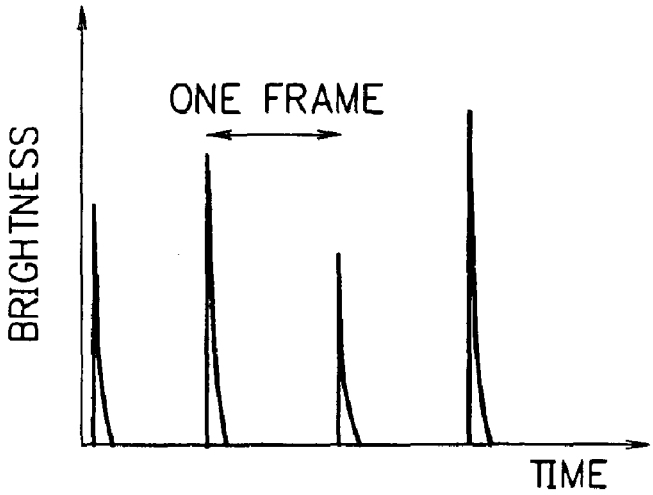
F I G. 1 PRIOR ART
FIG. 1 is a graph showing the brightness change of a pseudo type display device.
Figure 2:
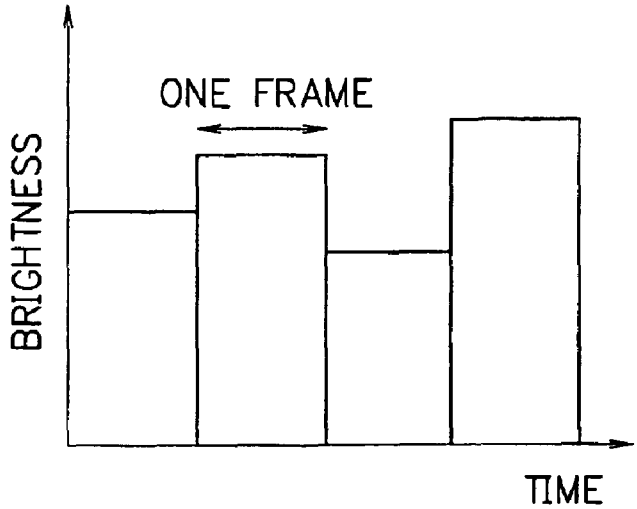
F I G. 2 PRIOR ART
FIG. 2 is a graph showing the brightness change of a hold type display device.
Figure 3:
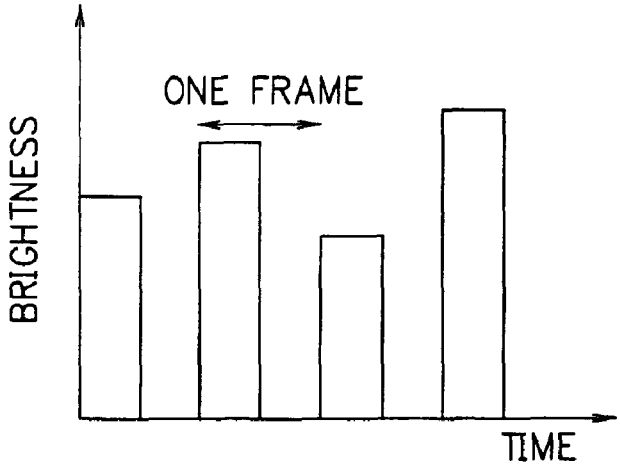
FIG. 3 PRIOR ART
FIG. 3 is a graph showing the brightness change of a pseudo impulse type display device.

Referring now to the drawings, a description of preferred embodiments of the present invention will be given in detail.

Figure 4:
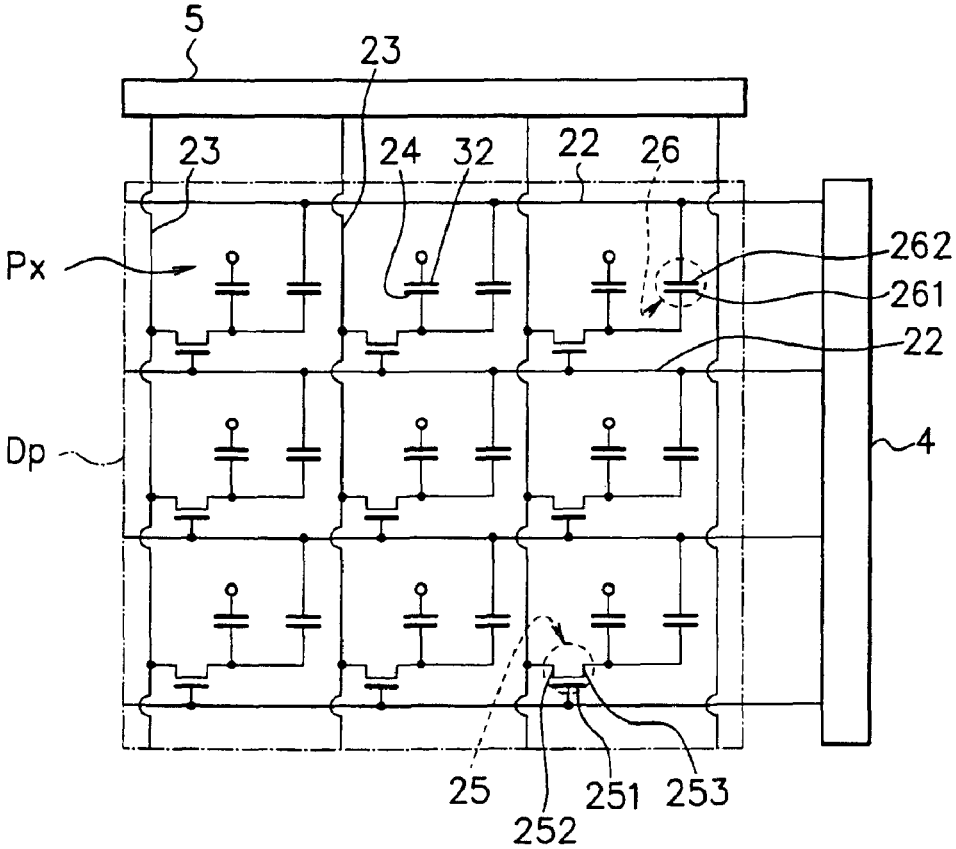
FIG. 4 is a schematic plane diagram showing an image display section of an LCD according to an embodiment of the present invention.

In the following description, a TN type active matrix color LCD device (described as an LCD in the following) is employed as the example of a display device, and it is matter of course that the present invention is to be applied for display devices of the other types. FIG. 4 is a schematic plane diagram showing the display section of the LCD, and FIG. 5 is a schematic sectional diagram showing one pixel of the LCD, which are referred to in the following embodiments.

Figure 5:
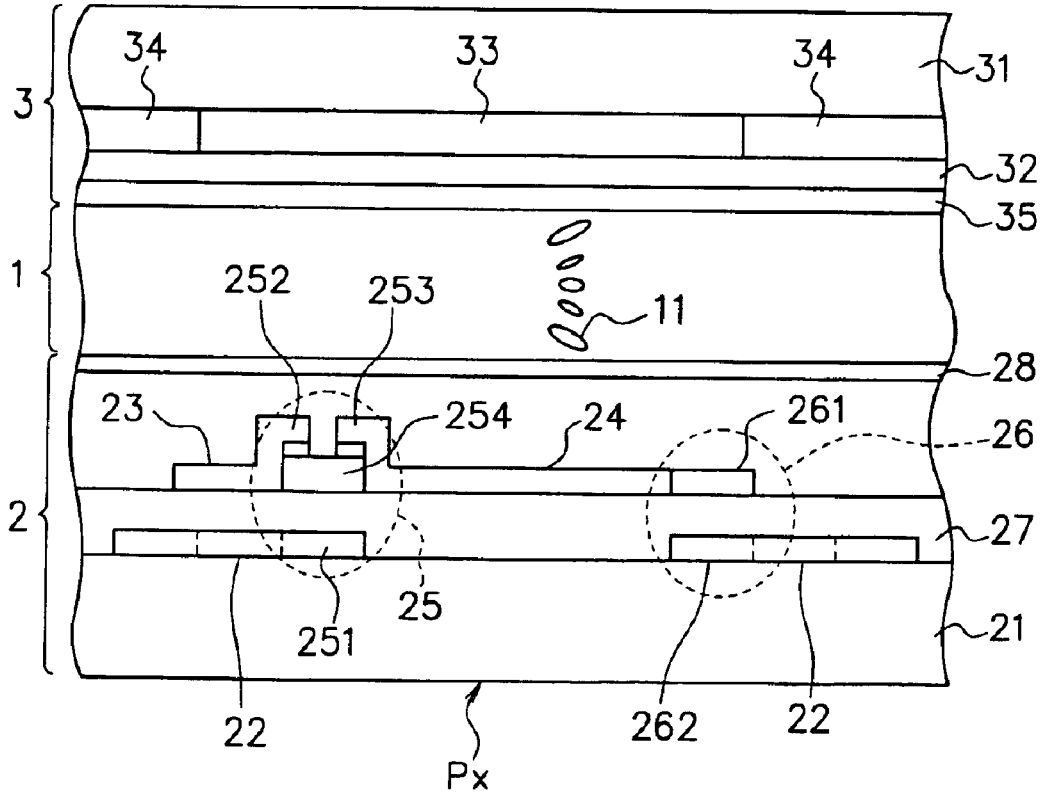
FIG. 5 is a schematic sectional diagram showing one pixel of the LCD of FIG. 4.

Referring to FIG. 5, the LCD basically has a TFT (thin film transistor) substrate 2 and a CF (color filter) substrate 3, which are oppositely disposed putting a liquid crystal layer 1 between them. Taking a plan view of the TFT substrate 2, as shown in FIG. 4, in the display area Dp of a glass substrate 21, some parallel scanning lines 22 and some signal lines 23 . . . intersect vertically in non-contact, and at the areas surrounded by these lines, pixels Px are formed in matrix. Each of the scanning lines 22 is extended to the outside of the area Dp of the glass substrate 21 and connected to a scanning line driver 4. In the similar way, each of the signal lines 23 is extended to the outside of the area Dp of the glass substrate 21 and connected to a signal line driver 5.

Each pixel Px of the TFT substrate 2 is provided with a pixel electrode 24, a TFT 25 and a storage capacitor 26 as its main components. Among these three components, the pixel electrode 24 is a transparent electrode including ITO (indium tin oxide). The pixel electrode 24 and a common electrode 32 in the CF substrate 3, which also includes ITO, form couple electrodes in order to drive a liquid crystal layer 1.

The TFT 25 comprises a gate electrode 251 extended from the scanning line 22, a drain electrode 252 extended from the signal line 23, a source electrode 253 extended from the pixel electrode 24, and a semiconductor layer 254 included amorphous silicon. The combination of these components forms a TFT having an opposite-stagger shape. The storage capacitor 26 is provided with a capacity electrode 261 extended from the pixel electrode 24 and a common capacity electrode 262 extended from the scanning line 22 to the area of relevant pixel Px. These two capacity electrodes have a gate insulation layer 27 between them, where electrostatic capacity is stored.

In each pixel Px of the CF substrate 3, a glass substrate 31 and a common electrode 32 have a color filter layer 33 and black matrices 34 between them. The color filter layer 33 has a color any one of three colors; red, green or blue, and is shaded the light by the black matrices 34. An orientation film 28 is formed at the contact surface of the TFT substrate 2 to the liquid crystal layer 1, and similarly an orientation film 35 at that of the CF substrate 3 to the liquid crystal layer 1. These two orientation films intersect vertically, so that the liquid crystal 1 becomes optically transparent when the electric field is unloaded.

As to the LCD of the present invention, when the scanning line driver 4 applies negative charge to the scanning lines 22 from the first to the last in order, and the signal line driver 5 provides positive charge with the signal lines 23 from the first to the last in order, at intersection, that is, the TFT 25 of the pixel Px, the drain electrode 252 and the source electrode 253 realize continuity. Thus, potential is generated between the pixel electrode 24 and the common electrode 32, and the liquid crystal layer 1 is to be driven. At the liquid crystal layer 1, the arrangement of liquid crystal molecules 11 is varied corresponding to the applied potential difference, and shading degree is enlarged as potential difference is increased.

Preventing electricity from passing into a pixel Px, the TFT 25 becomes without continuity. However, since the storage capacitor 26 holds potential by storing static electricity, potential between the pixel electrode 24 and the common electrode 32 is held until the next signal is transferred, and thus the liquid crystal layer 1 maintains the current brightness as it is. This is the process how the LCD becomes a hold type display device.

The luminosity signal is inputted to the signal line driver 5, which controls the brightness of the concerned pixel. The luminosity signal generally contains brightness information in the form of a digital signal. In the following embodiments, the digital signal is composed of a binary series having eight bits. When the luminosity signal is inputted to the signal line driver 5, the signal line driver generates potential difference corresponding to the luminosity signal, and transfers it to the concerned pixel Px. In the pixel Px, the liquid crystal layer 1 is driven by this potential difference, and transmission luminous is varied according to the transferred potential difference. Thus, contrast of the relevant pixel is determined. The luminosity signal having eight bits expresses 256 gradations.

As described above, by charging the scanning lines and the signal lines in order, each pixel Px of the LCD expresses a picture whose brightness is corresponding to the luminosity signal. In the following embodiments, each one frame (a term for displaying a picture) from the point of the antecedent picture signal being inputted to the point of the subsequent picture signal being inputted is 1/60 seconds. Since one frame is time-divided into two sub-frames, each one frame means to be 1/120 seconds. In this way, all the LCDs of the following embodiments are driven by 120 hertz. It is needless to say that the present invention is applied to those LCDs with other drive frequencies.

First Embodiment

Figure 6:
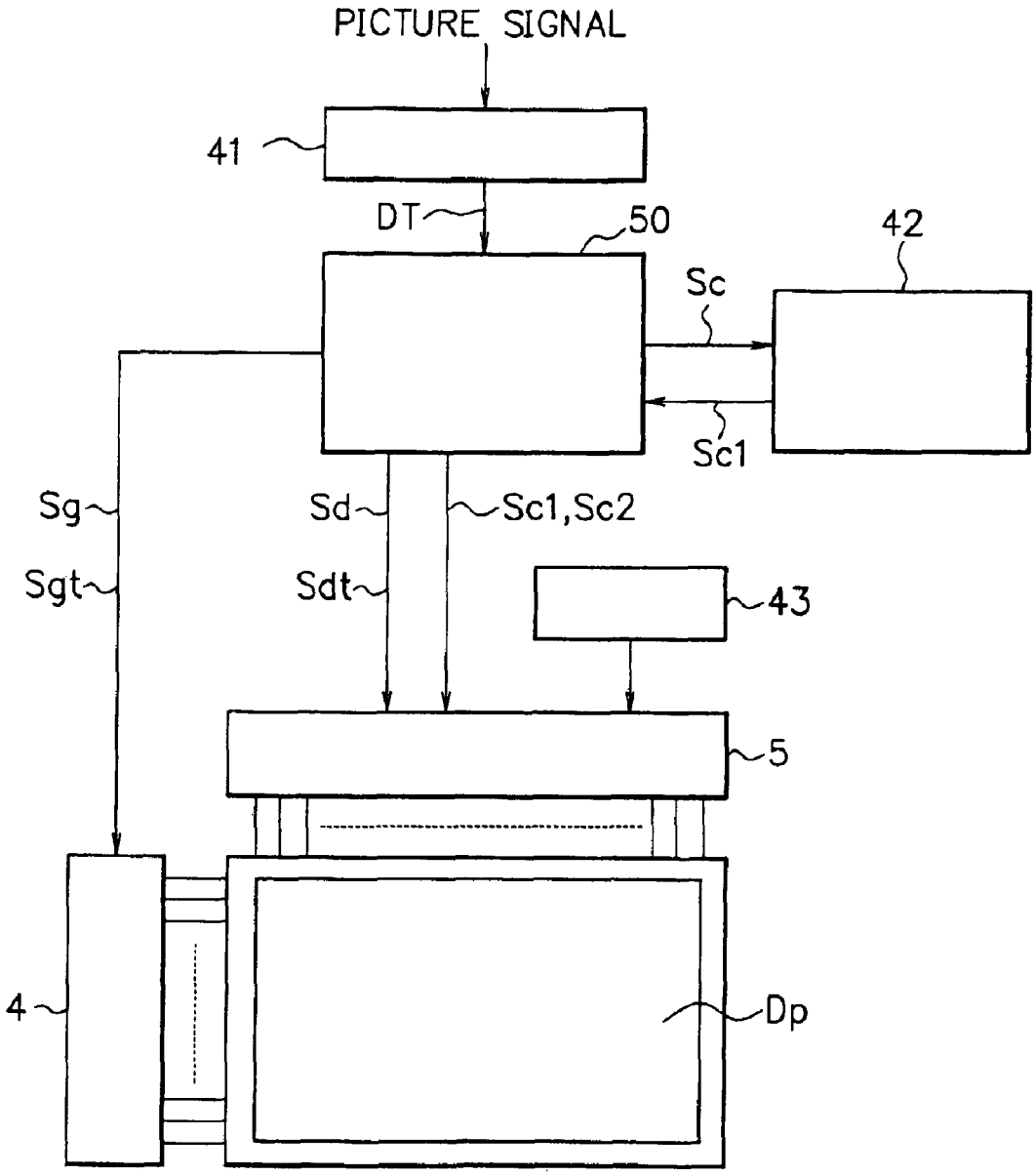
FIG. 6 is a block diagram showing a control means of the image of an LCD according to the first embodiment of the present invention.

FIG. 6 is a block diagram of the LCD of the first embodiment, showing the control means which controls pictures of each pixel Px in a pixel area Dp. In FIG. 6, the control means comprises an A/D converter 41, a control device 50, a frame buffer 42, a resolution power source 43, the scanning line driver 4 and the signal line driver 5.

The picture information which contains both the brightness information on each color of red, green and blue, transmitted in the form of analog signals, and synchronization signals, is converted into digital signals DT by the A/D converter 41, and then inputted to the control device 50.

The control device 50 transmits a luminosity signal Sc regarding the respective colors of red, green and blue, to the frame buffer 42 which generates sub-frames, a generated vertical clock signal Sgt and scanning line starting signal Sg to the scanning line driver 4, and a generated horizontal clock signal Sdt and a signal line starting signal Sd, as well as, a luminosity signal Sc1 containing the brightness information on red, green and blue colors, and an attenuation signal Sc2 to the signal line driver 5. The signal line driver 5 receives power transfer from the resolution power source 43, converts the luminosity signal Sc1 and the attenuation signal Sc2 into brightness control potential difference respectively, and transmits them to the relevant pixel in a pixel area Dp.

Figure 7:
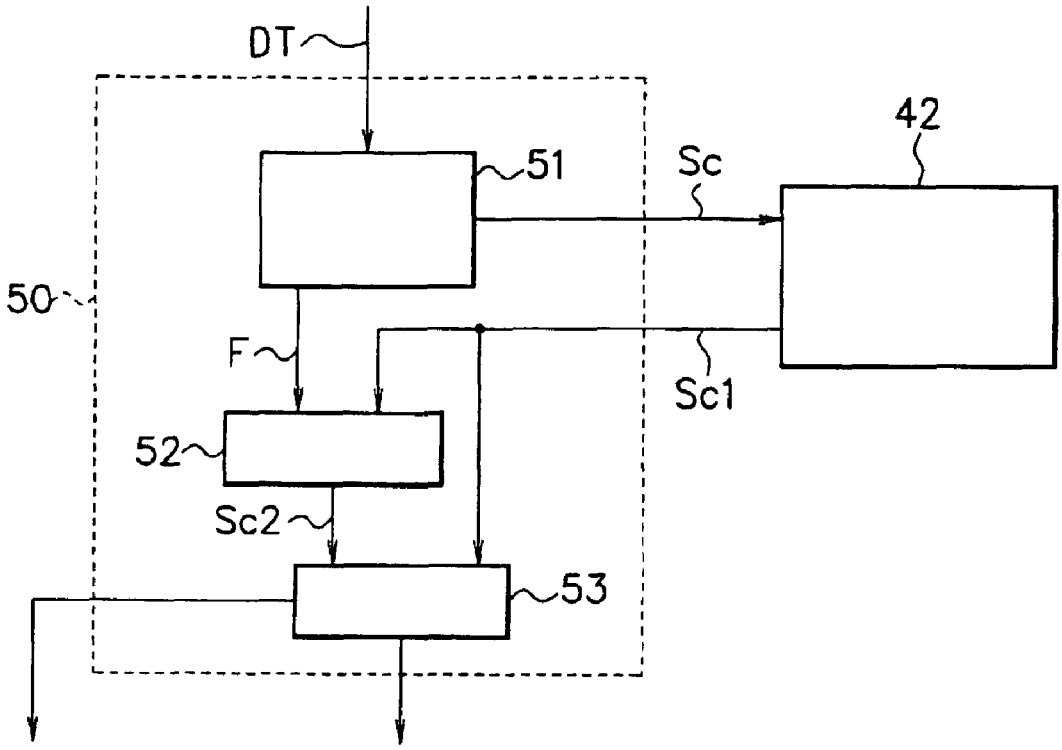
FIG. 7 is a block diagram showing an example of a control device.
Figure 8:
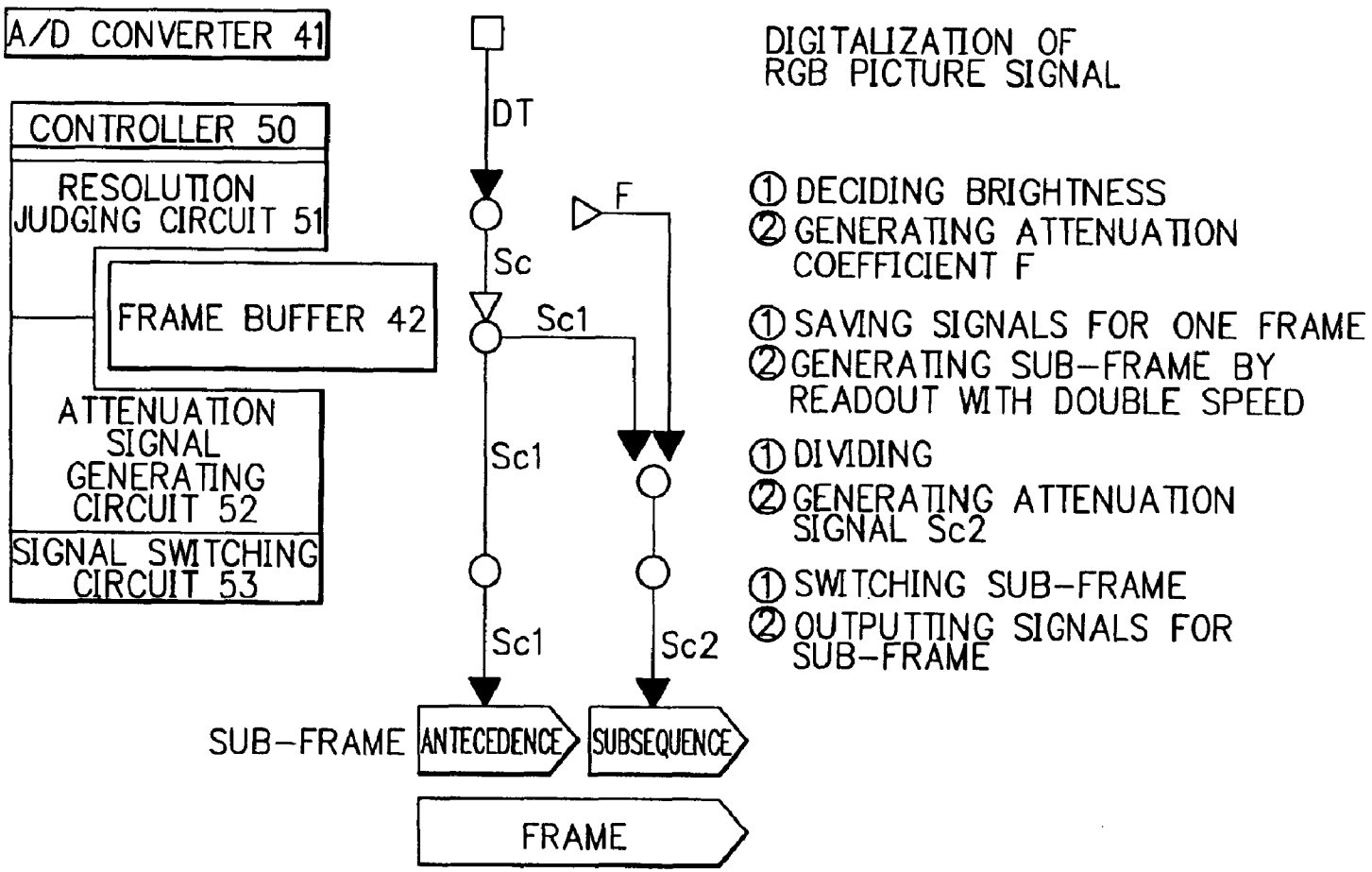
FIG. 8 is a flow diagram of signal processing.

As shown in FIG. 7, a block diagram of circuits and in FIG. 8, a flow diagram of signal processing, the control device 50 comprises a resolution judging circuit 51, an attenuation signal generating circuit 52 and a signal switching circuit 53.

The resolution judging circuit 51 recognizes a luminosity signal Sc corresponding to one frame of each pixel in a pixel range Dp by having digital signals DT of picture information inputted. At the same time, the resolution judging circuit 51 judges the brightness of respective colors and generates an attenuation coefficient F. In this embodiment, the attenuation coefficient F is a fixed value, and concretely, set at "4". A luminosity signal Sc of respective colors is outputted to the frame buffer 42, and the attenuation coefficient F is outputted to the attenuation signal generating circuit 52.

In order to divide the inputted luminosity signals Sc to the antecedent and the subsequent sub-fames, the frame buffer 42 saves the luminosity signals Sc. At the same time, it generates two sub-frames by; reading the data corresponding to one frame at double speed, and rereading the same data over again with a newly designated address for the subsequent sub-frame. In this way, the frame buffer 42 outputs a luminosity signal Sc1 with double speed to the signal switching circuit 53 for the antecedent sub-frame, at the same time, outputs the same data to the attenuation signal generating circuit 52 for the subsequent sub-frame.

The attenuation signal generating circuit 52, which is composed of an LSI for processing operation for instance, divides the luminosity signal Sc1 inputted from the frame buffer 42 by the attenuation coefficient F (which is "4" in this embodiment) transmitted from the resolution judging circuit 51, and generates an attenuation signal Sc2. The attenuation signal Sc2 is outputted to the signal switching circuit 53.

The signal switching circuit 53, which is composed of a multiplexer for example, outputs luminosity signals to the signal line driver 5 by changing a luminosity signal Sc1 inputted directly from the frame buffer 42 to the antecedent sub-frame, and an attenuation signal Sc2 inputted from the attenuation signal generating circuit 52 to the subsequent sub-frame.

Signal flow of the first embodiment is described in FIG. 8. The picture signal containing the brightness information of respective colors of red, green and blue, for one frame, which is inputted in the form of analog signals, is inputted to the A/D converter 41 and converted to a digital signal DT. The brightness of respective colors is read at the resolution judging circuit 51 of the controller 50, and speed of the luminosity signal Sc of respective colors of red, green and blue, is doubled at the frame buffer 42. And thus, a luminosity signal Sc1 for the antecedent sub-frame is allocated to the antecedent sub-frame by the signal switching circuit 53.

The luminosity signal Sc1 of respective colors of the antecedent sub-frame is converted into brightness control potential difference by receiving power feed from the resolution power source 43 at the signal line driver 5, transmitted to the concerned pixel in a pixel area Dp and controls the direction of the liquid crystal molecules at the antecedent sub-frame. On the other hand, at the frame buffer 42, a luminosity signal Sc1, whose speed is doubled in the same frame, is recalled, and transmitted to the attenuation signal generating circuit 52. At the attenuation signal generating circuit 52, the luminosity signal Sc1 is divided by an attenuation coefficient F (=4) outputted from the resolution judging circuit 51 as below;

$$Sc2=Sc1/4$$

and generates an attenuation signal Sc2 which contains the above brightness information.

The attenuation signal Sc2 is allocated to the subsequent sub-frame by the signal switching circuit 53, and at the signal line driver 5, an attenuation signal Sc2 of respective colors is converted to brightness control potential difference by receiving power feed from the resolution power source 43. And then, it is transmitted to the relevant pixel in a pixel area Dp and controls the direction of the liquid crystal molecules at the subsequent sub-frame.

Figure 9:
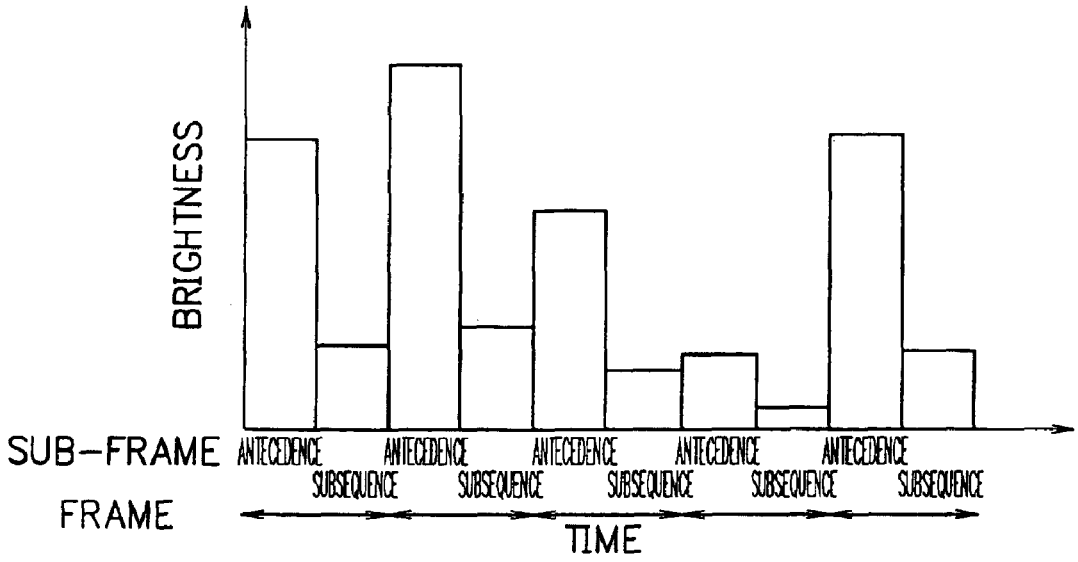
FIG. 9 is a graph showing the brightness change found in one pixel.

FIG. 9 describes how brightness of one pixel is changed as time passes. As shown in FIG. 9, in each frame of the concerned pixel, the brightness of the subsequent sub-frame is consistently one fourth of that of the antecedent sub-frame. With this point in mind, it turns out that the larger the brightness of an image signal inputted to one frame is, the larger the difference between the absolute value of brightness and the brightness of the subsequent sub-frame is. A moving picture tends to be visually unclear and blurred or disordered especially when the monitor is bright. However, as explained above, the LCD of the first embodiment enlarges the brightness difference with the subsequent sub-frame in case of a bright monitor. In this way, the LCD is able to prevent the picture from being blurred or disordered and unclear, since the same visual effectiveness is obtained as the pseudo impulse method in which the subsequent sub-frame is not displayed.

Furthermore, in the LCD of the first embodiment, the subsequent sub-frame consistently maintains one fourth of brightness of the antecedent sub-frame, and thus brightness contrast between frames is not varied and the frame becomes brighter than that of the impulse method in which the subsequent sub-frame is not displayed. Comparing brightness Σ of one frame of the first embodiment with that of the pseudo impulse method, since Σ is calculated as below, wherein brightness of the antecedent sub-frame is C, and attenuation coefficient is F:

$$\Sigma=(C+C/F)C$$

assuming that C=1 and F=4, then Σ=1.25. That is to say, brightness of one frame of the first embodiment is higher than that of conventional pseudo impulse method by 25%.

In the above-mentioned first embodiment, the attenuation coefficient F is fixed to "4". However, the attenuation coefficient F can be a variable [F=f(Sc)] which varies according to the brightness (Sc) of a picture signal inputted to the relevant frame. For instance, the resolution judging circuit 51 can generate the attenuation coefficient F so that the value of an attenuation coefficient becomes bigger in proportion as the inputted brightness value is bigger. Depending on how F function is selected, such an LCD is available as can display the movement more naturally without wasting the brightness of the monitor.

On the other hand, in the above-mentioned first embodiment, when an attenuation coefficient F is fixed, it is not necessary for the resolution judging circuit 51 to generate an attenuation coefficient F, and the attenuation signal generating circuit 52 can include an attenuation coefficient generating circuit instead.

Second Embodiment

Figure 10:
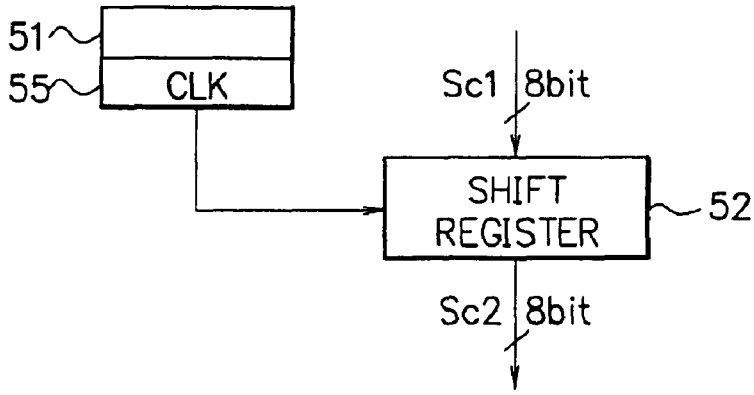
FIG. 10 is a block diagram showing an example of a circuit composition which generates an attenuation signal.

The second embodiment shows one example of circuit compositions which generates an attenuation signal Sc2 for the subsequent sub-frame by the resolution judging circuit 51 and the attenuation signal generating circuit 52 as shown in FIG. 8. FIG. 10 describes the circuit composition of the second embodiment. According to FIG. 10, the resolution judging circuit 51 of the second embodiment, as a generation circuit of an attenuation coefficient F, contains a clock circuit 55 which generates a clock signal to be inputted to the attenuation signal generating circuit 52. In the second embodiment, the attenuation coefficient signal generating circuit 52 is provided with a shift register.

According to the circuit composition shown in FIG. 10, it is possible to select an attenuation coefficient F by binary number as 2, 4, 8, . . . . For example, when an attenuation coefficient F is to be "2", such a clock signal should be generated as has the same clock number as a picture signal and an inverted phase. When the clock signal is inputted to the attenuation signal generating circuit 52 provided with a shift register, a luminosity signal Sc1 composed of a binary series of eight bits moves the digits one place to the right, and the attenuation signal Sc2 with the half brightness of the original luminosity signal Sc1 is outputted from the attenuation signal generating circuit 52.

As the first embodiment, when the attenuation coefficient F is to be "4", such a clock signal should be generated as has a double speed of a picture signal. In this way, a luminosity signal Sc1 shifts two places in the direction of the low order digit, and an attenuation signal Sc2 with the one fourth brightness of the original luminosity signal Sc1 is outputted from the attenuation signal generating circuit 52. For example, letting a luminosity signal Sc1 of eight bits be [1111111] with 256 gradations, the attenuation signal Sc2 which has shifted by two places to the right becomes [00111111] with 64 gradations, and the brightness of the attenuation signal Sc2 becomes one fourth of the luminosity signal Sc1.

In the same manner, when an attenuation coefficient F is to be "8", such a clock signal should be generated as has a speed four times as fast as a picture signal. In this way, an attenuation signal Sc2 with one eighth brightness of the original luminosity signal Sc1 is obtained. In the same way as the above examples, attenuation signals Sc2 with one sixteenth, one thirty-second, . . . of the brightness of the original luminosity signals Sc1 are to be obtained. However, it is not realistic when the attenuation signal Sc2 is extremely small, because there is no big difference practically comparing with the pseudo impulse method.

Third Embodiment

Figure 11:
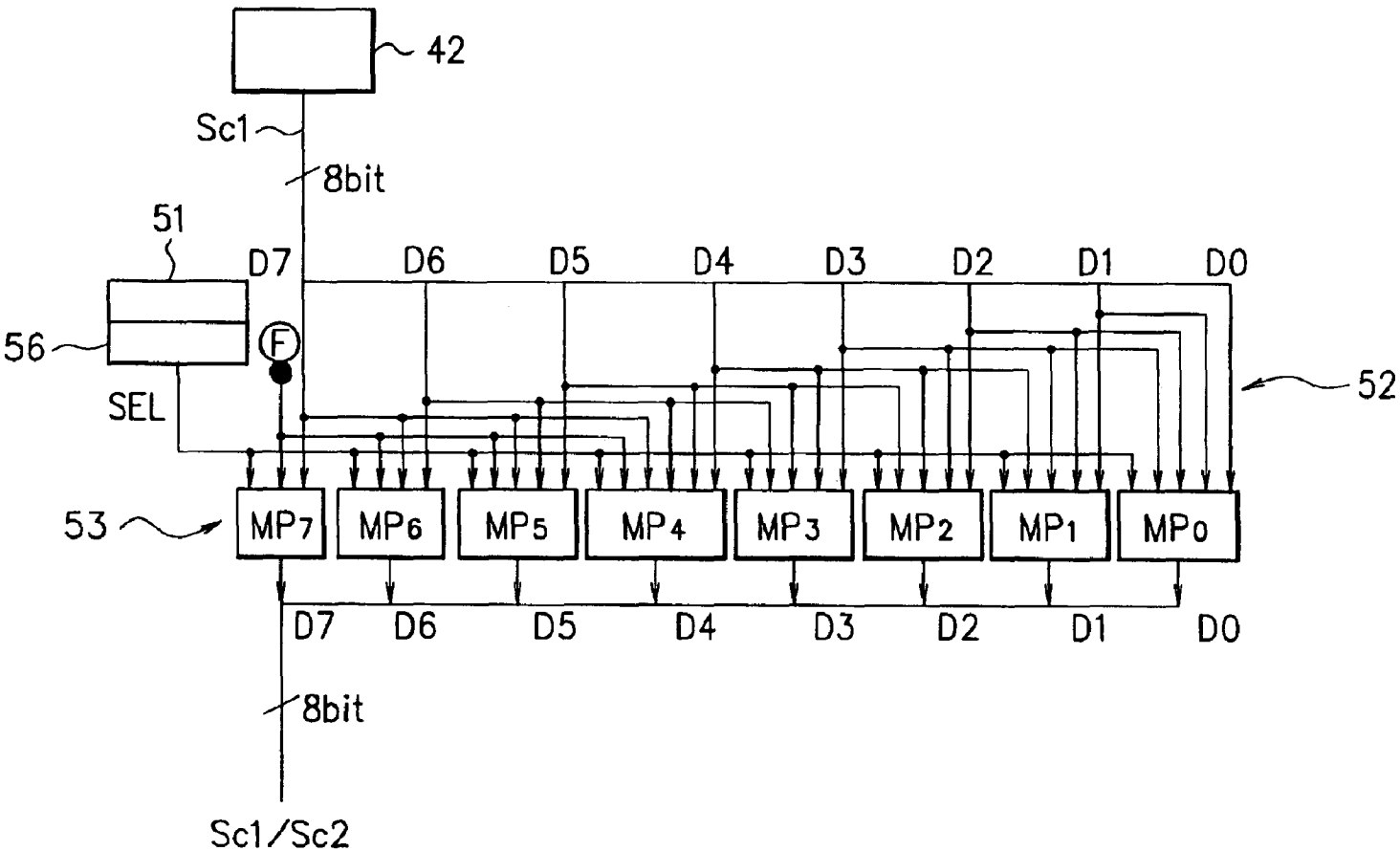
FIG. 11 is a block diagram showing another example of a circuit composition which generates the attenuation signal.

The third embodiment shows another example of circuit compositions which generate an attenuation signal Sc2 for the subsequent sub-frame by the resolution judging circuit 51 and the attenuation signal generating circuit 52 as shown in FIG. 8. FIG. 11 shows the circuit composition of the third embodiment. According to FIG. 11, the resolution judging circuit 51 of the third embodiment is provided with a line selecting circuit 56 which generates a line selection signal SEL at the subsequent sub-frame corresponding to the designated attenuation coefficient F. The signal switching circuit 53 of the third embodiment is composed of multiplexers from MP0 to MP7, which are corresponding to each of eight bus lines with eight bits from D0 to D7.

In the third embodiment, a luminosity signal Sc1 with eight bits outputted from the frame buffer 42, at the antecedent sub-frame, goes through the bus lines and passes the attenuation signal generating circuit 52 without being revised. And then, it is transmitted to the signal switching circuit 53 directly, synchronized with the antecedent sub-frame, and outputted to the signal line driver 5 as a luminosity signal Sc1.

At the subsequent sub-frame, a luminosity signal Sc1 with eight bits, which is outputted from the frame buffer 42 over again, goes through the bus lines, and is inputted to the attenuation signal generating circuit 52. At the same time, the attenuation coefficient F which is designated in advance as a bit-digit number (i.e., F will be two bits when the brightness is to be reduced to one fourth) is inputted to the attenuation signal generating circuit 52, and from the line selecting circuit 56 of the resolution judging circuit 51, a line selection signal SEL corresponding to attenuation coefficient F is inputted to the attenuation signal generating circuit 52.

Figure 12:
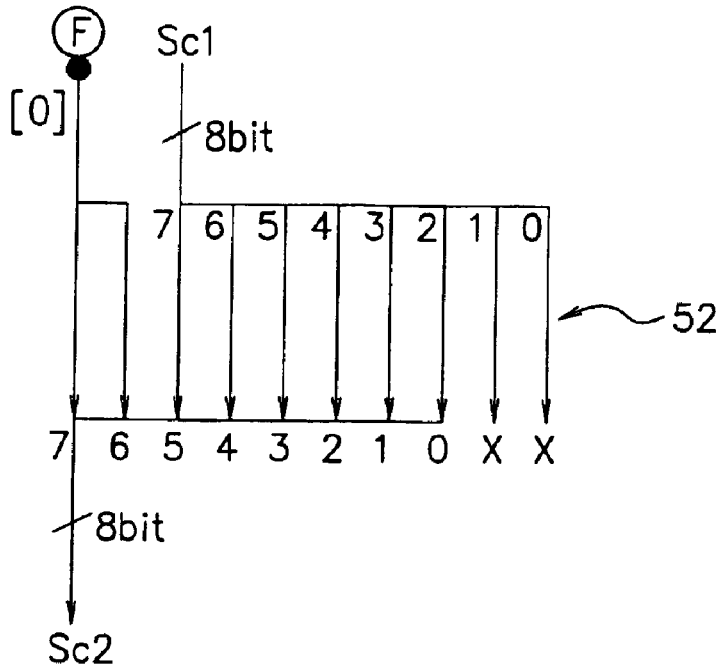
FIG. 12 is a circuit diagram showing a mode which generates the attenuation signal.

In the attenuation signal generating circuit 52, at the subsequent sub-frame, using a line selection signal SEL a luminosity signal (which is inputted to each of multiplexers from MP0 to MP7) is shifted its digits to the lower place by the number of bits, which is equivalent to the attenuation coefficient F. Signal [0] is inputted to the blank space of the upper order digits, and the lower bits which are overflowed from the multiplexers are truncated. To give a concrete example, as shown in FIG. 12, among signals with eight bits inputted to the attenuation signal generating circuit 52, only the signals of lower two bits ([0] and [1]) are truncated. The signals of [2] to [7] bits are outputted as the signals of [0] to [5] bits. The outputted attenuation signal Sc2 becomes one fourth of the original luminosity signal Sc1. If the brightness of the subsequent sub-fame is fixed to be one fourth of that of the antecedent sub-frame, the line selecting circuit 56 and multiplexers from MP0 to MP7 are to be omitted, and what should be done is only to provide a pattern for a circuit in which lines are directly connected, as shown in FIG. 12.

Fourth Embodiment

Figure 13:
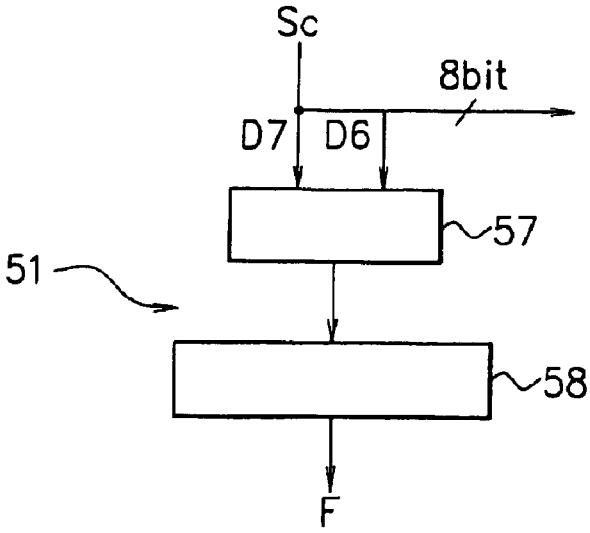
FIG. 13 is a block diagram showing an example of a resolution judging circuit.

The fourth embodiment shows one example of the resolution judging circuit 51 which generates an attenuation coefficient F based on the luminosity signal of the entire pixel forming a picture in one frame. FIG. 13 shows a circuit composition of a resolution judging circuit of the fourth embodiment. The resolution judging circuit 51 comprises a counter 57 and a comparator 58.

Among the luminosity signals Sc of each pixel, which are outputted from a resolution judging circuit within the resolution judging circuit 51 to bus lines with eight bits, the signals of upper two bits (D7 and D6) are inputted to the counter 57 separately. This inputted data is integrated for the entire pixel composing the monitor of one frame. The reason for integrating only the upper two bits is to reduce a load on a counter circuit, and also integration of the upper two bits is enough for judging the monitor brightness of one frame.

The comparator 58 has a threshold value of brightness of a picture. Comparing the threshold value with the integrated value of brightness of the entire pixel outputted from the counter 57, the comparator 58 generates a different attenuation coefficient F depending on the following two cases and outputs it to the attenuation signal generating circuit 52. The first case is when the integrated value of brightness is above the threshold value (when the entire monitor is brighter than the standard value) and the second case is when the integrated value of brightness is below the threshold value (when the entire monitor is darker than the standard value).

The reason for having the attenuation coefficient F changed by comparison with the threshold value is that the attenuation ratio of the subsequent sub-frame produces respective effects on visual contrast of a picture in case of a bright monitor and in case of a dark monitor. From this viewpoint, the above-mentioned threshold value and the corresponding attenuation coefficient F are determined experimentally. It is also possible that one designated attenuation coefficient F, in case of a dark monitor for example, is unloaded, that is, the brightness of the subsequent sub-frame is not attenuated. The attenuation coefficient F from the comparator 58 is inputted to the attenuation signal generating circuit 52 with one of the circuit compositions described in the first, the second and the third embodiments.

Since the LCD of the fourth embodiment determines an attenuation coefficient F depending on the overall brightness of a picture in one frame, the following advantages are realized. For instance, in case of a bright monitor, a visually blurred or disordered picture is avoided by increasing an attenuation coefficient F so that the subsequent sub-frame becomes relatively dark, and in case of a dark monitor, visual perception for the dark part of the picture is improved by reducing an attenuation coefficient F so that the subsequent sub-frame becomes relatively bright. Conversely, it is also possible for the bright monitor to be brighter with a small attenuation coefficient, and for the dark monitor to be darker with a large attenuation coefficient. In this way, the dynamic range of contrast can be improved.

Fifth Embodiment

Figure 14:
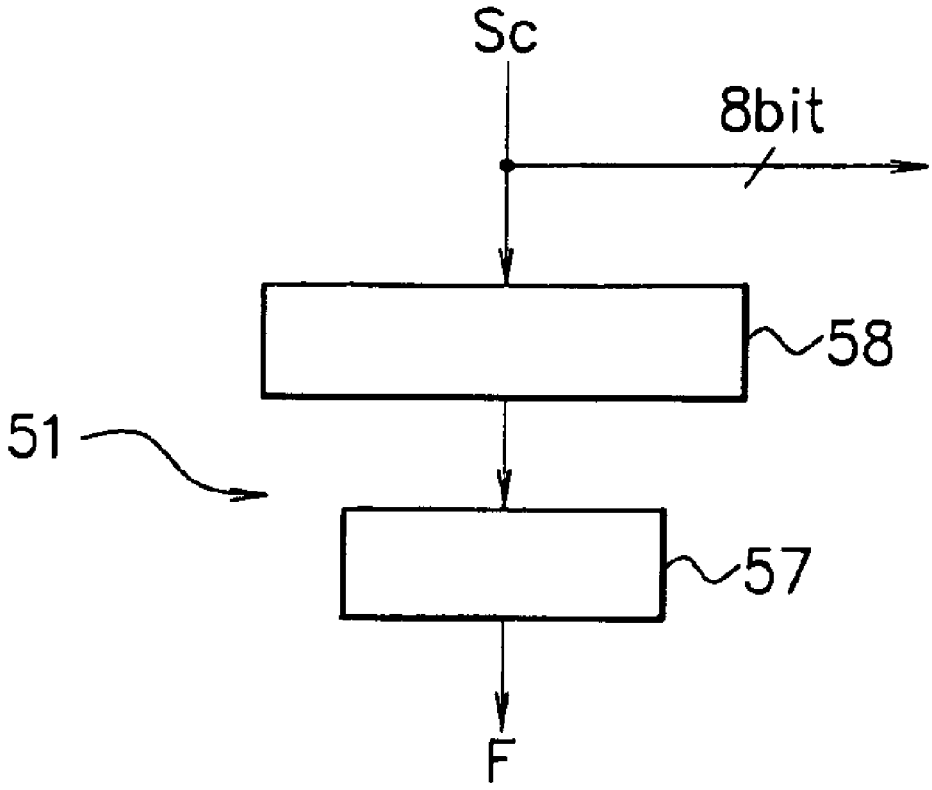
FIG. 14 is block diagram showing another example of a resolution judging circuit.

The fifth embodiment of the present invention shows one example of the resolution judging circuit 51 which outputs an attenuation coefficient changed according to the luminosity level of luminosity signals. FIG. 14 shows a circuit composition of a resolution judging circuit of the fifth embodiment. The resolution judging circuit 51 comprises a comparator 58 and a RAM 59.

The comparator 58 contains a plurality of luminosity levels such as L1, L2, and L3 and so on. Being supplied with a luminosity signal Sc of each pixel, the comparator 58 compares it with each luminosity level, and thereby the appropriate resolution segment for the relevant luminosity signal Sc is determined.

In the RAM 59, each resolution segment has its special attenuation coefficient F. The RAM 59 distributes the luminosity signal Sc, whose resolution segment is designated by the comparator 58, to the designated segment and outputs the relevant attenuation coefficient F which is peculiarly set to each resolution segment.

The outputted attenuation coefficient F is inputted to the attenuation signal generating circuit 52 with one of the circuit compositions described in the first, the second and the third embodiments. The luminosity signal Sc inputted to the comparator 58 can be expressed by pixel unit, or a luminosity signal of the entire monitor of one frame. In case of using a luminosity signal of the entire monitor, as described in the fourth embodiment, the following procedure is also available. Among luminosity signals Sc of each pixel, the signals of upper two bits (D7 and D6) are inputted separately, the inputted data is integrated for the entire pixel composing the monitor of one frame, and the obtained integrated value is inputted to the comparator 58.

The LCD of the fifth embodiment divides the inputted luminosity signal into the multiple number of resolution segments according to the luminosity level, and outputs the attenuation coefficient F whose value is designated in advance to be suitable for the brightness of the segment. Thus, it is possible to carefully select an attenuation coefficient F in consideration of the brightness of a pixel or a monitor. As a result, the two contrary factors are realized; preventing a moving picture between consecutive frames from being blurred or disordered and unclear, and maintaining contrast of the picture. In this way, the LCD is able to express a moving picture which is visually perceived at high level.

While the present invention has been described with reference to the particular illustrative embodiments, it is not to be restricted by this embodiments but only by the appended claims. It is to be appreciated that those skilled in the art can change or modify the embodiments without departing from the spirit and scope of the present invention.

What is claimed is:

1. A display device being a hold type display device which holds a brightness of the antecedent picture until the subsequent signal is inputted to a pixel, wherein:

a frame displaying one picture is time-divided into multiple sub-frames; and a brightness of each subsequent sub-frame of said frame is attenuated at a same designated ratio with respect to a brightness of a preceding sub-frame.

2. A display device comprising:

a sub-frame generating means which time-divides a frame displaying one picture into multiple sub-frames;

an attenuation signal generating means for generating an attenuation signal by dividing an inputted luminosity signal by a designated attenuation coefficient; and a signal switching means for inputting the luminosity signal before division to the antecedent sub-frame in the relevant frame, and inputting the attenuation signal after division to the subsequent sub-frame in the relevant frame.

3. A display device being a hold type display device which holds a brightness of the antecedent picture until the subsequent signal is inputted to a pixel, wherein:

a frame displaying one picture is time-divided into multiple sub-frames; and the brightness of the subsequent sub-frame is attenuated at a designated ratio according to the brightness of inputted picture, comprising:

a sub-frame generating means which time-divides a frame displaying one picture into multiple sub-frames;

an attenuation signal generating means for generating an attenuation signal by dividing an inputted luminosity signal by a designated attenuation coefficient; and a signal switching means for inputting the luminosity signal before division to the antecedent sub-frame in the relevant frame, and inputting the attenuation signal after division to the subsequent sub-frame in the relevant frame.

4. A display device comprising:

a sub-frame generating means which time-divides a frame displaying one picture into multiple sub-frames;

an attenuation signal generating means for generating an attenuation signal by dividing an inputted luminosity signal by a designated attenuation coefficient; and a signal switching means for inputting the luminosity signal before division to the antecedent sub-frame in the relevant frame, and inputting the attenuation signal after division to the subsequent sub-frame in the relevant frame, wherein:

the attenuation signal generating means generates a signal by shifting the series of a digitalized luminosity signal in the direction of the low order digit and eliminating the digits which are underflowed due to the shift, and outputs the generated signal as the attenuation signal.

5. A display device being a hold type display device which holds the brightness of the antecedent picture until the subsequent signal is inputted to a pixel, comprising:

a sub-frame generating means which time-divides a frame displaying one picture into multiple sub-frames;

an attenuation signal generating means for generating an attenuation signal by dividing an inputted luminosity signal by a designated attenuation coefficient; and a signal switching means for inputting the luminosity signal before division to the antecedent sub-frame in the relevant frame, and inputting the attenuation signal after division to the subsequent sub-frame in the relevant frame, wherein:

a frame displaying one picture is time-divided into multiple sub-frames;

the brightness of the subsequent sub-frame is attenuated at a designated ratio according to the brightness of inputted picture; and the attenuation signal generating means generates a signal by shifting the series of a digitalized luminosity signal in the direction of the low order digit and eliminating the digits which are underflowed due to the shift, and outputs the generated signal as the attenuation signal.

6. A display device comprising:

a sub-frame generating means which time-divides a frame displaying one picture into multiple sub-frames;

an attenuation signal generating means for generating an attenuation signal by dividing an inputted luminosity signal by a designated attenuation coefficient;

a signal switching means for inputting the luminosity signal before division to the antecedent sub-frame in the relevant frame, and inputting the attenuation signal after division to the subsequent sub-frame in the relevant frame;

an integration means for integrating the luminosity signals of entire pixels which form a picture in the relevant frame; and an attenuation coefficient generating means for generating an attenuation coefficient which is varied according to the obtained integrated value.

7. A display device being a hold type display device which holds the brightness of the antecedent picture until the subsequent signal is inputted to a pixel, wherein:

a frame displaying one picture is time-divided into multiple sub-frames, and the brightness of the subsequent sub-frame is attenuated at a designated ratio according to the brightness of inputted picture, comprising:

a sub-frame generating means which time-divides a frame displaying one picture into multiple sub-frames;

an attenuation signal generating means for generating an attenuation signal by dividing an inputted luminosity signal by a designated attenuation coefficient;

a signal switching means for inputting the luminosity signal before division to the antecedent sub-frame in the relevant frame, and inputting the attenuation signal after division to the subsequent sub-frame in the relevant frame;

an integration means for integrating the luminosity signals of entire pixels which form a picture in the relevant frame; and an attenuation coefficient generating means for generating an attenuation coefficient which is varied according to the obtained integrated value.

8. A display device comprising:

a sub-frame generating means which time-divides a frame displaying one picture into multiple sub-frames;

an attenuation signal generating means for generating an attenuation signal by dividing an inputted luminosity signal by a designated attenuation coefficient;

a signal switching means for inputting the luminosity signal before division to the antecedent sub-frame in the relevant frame, and inputting the attenuation signal after division to the subsequent sub-frame in the relevant frame;

an integration means for integrating the luminosity signals of entire pixels which form a picture in the relevant frame; and an attenuation coefficient generating means for generating an attenuation coefficient which is varied according to the obtained integrated value, wherein:

the attenuation signal generating means generates a signal by shifting the series of a digitalized luminosity signal in the direction of the low order digit and eliminating the digits which are underflowed due to the shift, and outputs the generated signal as the attenuation signal.

9. A display device being a hold type display device which holds the brightness of the antecedent picture until the subsequent signal is inputted to a pixel, comprising:

a sub-frame generating means which time-divides a frame displaying one picture into multiple sub-frames;

an attenuation signal generating means for generating an attenuation signal by dividing an inputted luminosity signal by a designated attenuation coefficient;

a signal switching means for inputting the luminosity signal before division to the antecedent sub-frame in the relevant frame, and inputting the attenuation signal after division to the subsequent sub-frame in the relevant frame;

an integration means for integrating the luminosity signals of entire pixels which form a picture in the relevant frame; and an attenuation coefficient generating means for generating an attenuation coefficient which is varied according to the obtained integrated value, wherein:

a frame displaying one picture is time-divided into multiple sub-frames;

the brightness of the subsequent sub-frame is attenuated at a designated ratio according to the brightness of inputted picture; and the attenuation signal generating means generates a signal by shifting the series of a digitalized luminosity signal in the direction of the low order digit and eliminating the digits which are underflowed due to the shift, and outputs the generated signal as the attenuation signal.

10. A display device as claimed in claim 2 comprising:

a luminosity classifying means for segmenting the inputted luminosity signals according to the luminosity level; and an attenuation coefficient generating means for generating an attenuation coefficient which is varied according to the segmented brightness range.

11. A display device as claimed in claim 3 comprising:

a luminosity classifying means for segmenting the inputted luminosity signals according to the luminosity level; and an attenuation coefficient generating means for generating an attenuation coefficient which is varied according to the segmented brightness range.

12. A display device as claimed in claim 4 comprising:

a luminosity classifying means for segmenting the inputted luminosity signals according to the luminosity level; and an attenuation coefficient generating means for generating an attenuation coefficient which is varied according to the segmented brightness range.

13. A display device as claimed in claim 5 comprising:

a luminosity classifying means for segmenting the inputted luminosity signals according to the luminosity level; and an attenuation coefficient generating means for generating an attenuation coefficient which is varied according to the segmented brightness range.

14. A display device as claimed in claim 6 comprising:

a luminosity classifying means for segmenting the inputted luminosity signals according to the luminosity level; and an attenuation coefficient generating means for generating an attenuation coefficient which is varied according to the segmented brightness range.

15. A display device as claimed in claim 7 comprising:

a luminosity classifying means for segmenting the inputted luminosity signals according to the luminosity level; and an attenuation coefficient generating means for generating an attenuation coefficient which is varied according to the segmented brightness range.

16. A display device as claimed in claim 8 comprising:

a luminosity classifying means for segmenting the inputted luminosity signals according to the luminosity level; and an attenuation coefficient generating means for generating an attenuation coefficient which is varied according to the segmented brightness range.

17. A display device as claimed in claim 9 comprising:

a luminosity classifying means for segmenting the inputted luminosity signals according to the luminosity level; and an attenuation coefficient generating means for generating an attenuation coefficient which is varied according to the segmented brightness range.

* * * * *